United States Patent [19]

Levine

[11] 4,265,032

[45] May 5, 1981

[54] EXPANDABLE ARTICLE OF FOOTWEAR

[75] Inventor: Beth Levine, New York, N.Y.

[73] Assignee: Betherb, Inc., New York, N.Y.

[21] Appl. No.: 48,487

[22] Filed: Jun. 14, 1979

[51] Int. Cl.[3] ..... A43B 3/12; A43B 7/06

[52] U.S. Cl. ..... 36/11.5; 36/3 R

[58] Field of Search ..... 36/11.5, 3 R, 3 A, 11

[56] References Cited

U.S. PATENT DOCUMENTS

| | | | |
|---|---|---|---|
| 948,300 | 2/1910 | Eastwood | 36/11 X |
| 1,763,605 | 6/1930 | Haskell | 36/36 A |
| 2,146,805 | 2/1939 | Engel | 36/11.5 |
| 2,696,057 | 12/1954 | Flautt | 36/11.5 |

FOREIGN PATENT DOCUMENTS

| | | | |
|---|---|---|---|
| 614009 | 5/1935 | Fed. Rep. of Germany | 36/3 A |
| Ad.58899 | 11/1953 | France | 36/11.5 |
| 447004 | 4/1949 | Italy | 36/3 A |
| 40316 | 7/1907 | Switzerland | 36/3 A |

*Primary Examiner*—James Kee Chi

*Attorney, Agent, or Firm*—Friedman, Goodman & Teitelbaum

[57] ABSTRACT

An expandable article of footwear having a sole with an upper formed over at least a portion of the sole. At least a part of the upper has formed therein an array of elongated slits. The slits are colinearly arranged into substantially parallel columns with the slits spaced part in the columnar direction. The slits of adjacent columns are in staggered relationship with each other. In this manner, when the article of footwear is worn, the openings defined by the slits expand into a generally oval shape.

13 Claims, 7 Drawing Figures

EXPANDABLE ARTICLE OF FOOTWEAR

BACKGROUND OF THE INVENTION

This invention relates to footwear construction, and more particularly to an article of footwear formed with an upper, where the upper can expand to accommodate various sizes.

In footwear construction, there is generally provided a sole with an upper formed thereon. There can also be included a heel, as well as other portions, depending upon the type and shape of the shoe.

However, since the shoe is formed of stiff material, typically leather, plastic, canvas, or the like, and since the upper is connected to the sole by means of stitching, adhesive, or the like, the size of the shoe is generally fixed to a particular foot size.

As a result, when one purchases a shoe, boot, slipper or the like, the size of the footwear must be commensurate with the foot size. If the size is too big or too small, it will not fit properly and will provide discomfort, and frequently damage to the wearer's foot.

As a result, it is necessary to carry a complete selection of footwear to accommodate all of the various foot sizes. Such sizes must not only include variations in length, but also variations in width, as well as combinations of length and width sizes. This requires a considerable amount of stock in any particular style in order to accommodate all foot sizes.

As a result, frequently, many sizes are not stocked in particular styles and the wearer must either resort to a different shoe style or compromise the particular foot size to one that is not exactly commensurate with his needs.

In addition to variations in size corresponding to different foot lengths and widths, even with a particular foot there are frequently variations during the course of the day as well as with changes in the seasons. For example, in the mornings when the foot is first placed in the shoe, after the foot has been raised for a considerable length of time during the nighttime in a rest position, the size of the foot is slightly smaller than at the end of the day when the foot has been in a vertical position with pressure on the foot for a considerable length of time. Similarly, during the summer, as a result of expansion, heat, moisture, and other conditions, the foot swells a bit in size greater than its winter size.

Despite these variations in foot size, during each day, each season, etc., a wearer generally does not change the shoe or other footwear between morning and nighttime to accommodate such changes, nor does he change the shoe size between summer and winter shoes. Accordingly, a shoe size that fits for certain days or certain times of the year may be discomforting for other periods of time.

Yet, furthermore, the comfort of the foot in the shoe will vary depending upon the thickness of the sock, stocking, etc., as well as because of various other factors concerning the effect of the environment on the shoe, the effect of the connection between the sole and the upper and many other variations.

Accordingly, with present existing footwear, even when a shoe is selected to fit a particular foot size, the shoe will not always provide a perfect fit and will not always give good comfort because of such variations during normal routines.

Another problem with existing footwear concerns the particular shape of the foot. While shoes are generally designed for an average foot shape, it is well known that such shape actually varies from person to person. While a particular style may accommodate one wearer's foot shape it may be most uncomfortable to another wearer even with the same foot size, since the particular shape of the foot may differ. This problem is even further compounded as a result of deformities in the foot, such as corns, bunions, etc.

As a result, existing footwear are not often designed to accommodate particular foot sizes and shapes, and in most cases a wearer must compromise style, size, shape, or some other aspect of footwear in order to obtain a shoe to wear.

In the prior art, an attempt has been made to try and accommodate at least a part of these problems by providing expandable shoes to accommodate a change in a single size. For example, U.S. Pat. No. 3,389,481 has a steel plate formed in the sole which permits movement between a first and second shoe size position. At the same time, the upper material itself is of crinkled leather, or the like, whereby it can be expanded between the two positions corresponding to the two sizes. Accordingly, especially for a child, the shoe can be utilized not only for the size for which it was purchased, but for the next size as well.

Another attempt to accommodate expansion of a shoe is provided in U.S. Pat. No. 1,110,624. In this case, there is provided an expandable edge portion in order to permit entry and exit of the foot into the shoe. The expansion is provided by means of an expandable rubber strap which is covered by a folded over piece of slitted leather to permit expansion of the rubber therebeneath. The leather is stitched at its bottom portion to prevent expansion of the leather itself and to only permit the leather to accommodate expansion of the rubber.

Neither of these approaches have truly addressed the essence of the problem of permitting full expansion of the entire upper in order to accommodate completely different foot sizes and shapes.

SUMMARY OF THE INVENTION

Accordingly, it is an object of the present invention to provide footwear which avoids the aforementioned problems of prior art footwear.

Yet another object of the present invention is to provide an expandable article of footwear which can accommodate various foot sizes, shapes, and types.

Yet another object of the present invention is to provide an expandable article of footwear which can conform to the shape of the foot.

Still another object of the present invention is to provide an expandable article of footwear which can vary its size in order to accommodate variations in foot size during the course of daily or seasonal changes.

Another object of the present invention is to provide an expandable article of footwear which can provide comfort to various foot shapes and sizes.

Yet another object of the present invention is to provide an expandable article of footwear which can expand during the course of normal routines to accommodate variations in foot size.

Still a further object of the present invention is to provide an expandable article of footwear which can provide comfort to a wearer's foot while yet providing beauty and style.

Still another object of the present invention is to provide an expandable article of footwear which can be easily manufactured and which can be stocked in styles which can cover a range of foot sizes.

Yet a further object of the present invention is to provide an expandable upper which can be utilized in the formation of numerous shoe styles including loafers, half boots, full boots, slippers, sandals, etc.

Briefly, in accordance with the present invention, there is provided an expandable article of footwear comprising a sole with an upper formed over at least a portion of the sole. At least a portion of the upper comprises an array of elongated slits colinearly arranged into substantially parallel columns. The slits are spaced apart in the columnar direction. The slits of adjacent columns are staggered with respect to each other.

In an embodiment of the invention, the length dimension of the slits is oriented in the direction of the foot form, whereby the toe and vamp portion have slits oriented in the longitudinal direction of the footwear while the heel and ankle portion have the slits vertically directed.

BRIEF DESCRIPTION OF THE DRAWINGS

With the above and additional objects and advantages in view, as will hereinafter appear, this invention comprises the devices, combinations and arrangements of parts hereinafter described by way of example and illustrated in the accompanying drawings of a preferred embodiment in which.

In the various figures of the drawing, like reference characters designate like parts.

DETAILED DESCRIPTION OF THE PREFERRED EMBODIMENT

Figure 1:
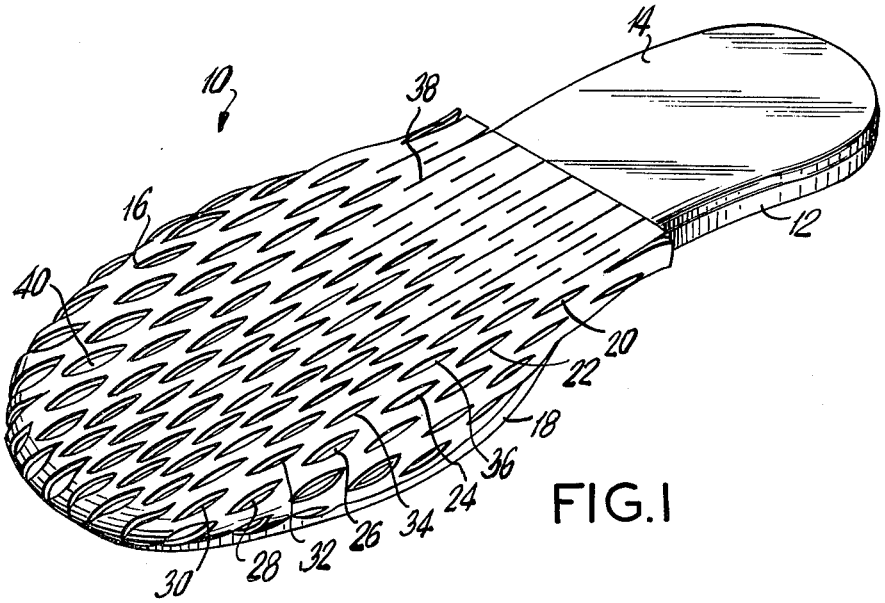
FIG. 1 is a perspective view of an embodiment of the present invention showing the expandable article of footwear as a slipper.

Referring now to FIG. 1, the article of footwear 10 is shown as a slipper and is formed with an outsole 12, upon which is placed an insole 14 and including an upper 16 formed over the toe and arch portion of the sole. The upper is held by conventional means of adhesive and/or stitching at the outer edge 18 where the upper is connected to the sole portion in the usual manner.

The upper comprises an array of elongated slits, one of which is shown at 20. The elongated slits are arranged colinearly into columns extending from the toe of the shoe. The columns are spaced apart from each other and are disposed in parallel relationship. The slits of adjacent columns are in staggered relationship with each other.

More specifically, the slits 20, 22, 24, 26, 28 all lie in a single colinear column. The slits are spaced apart from each other in the columnar direction. The next adjacent column on one side thereof comprises the elongated slits 30, 32, 34, 36, etc. These slits in the next adjacent column also are colinear with each other and are also spaced apart in a columnar direction. The slits of the first mentioned column are staggered with respect to the slits of the second mentioned column. Accordingly, the slit 32 is positioned longitudinally between the position of the slits 26 and 28. The slit 26, on the other hand, is positioned longitudinally between the slits 32 and 34. This pattern continues throughout the upper.

When the slits are initially formed during manufacture and prior to the entry of a foot into the slipper 10, the slits are in a contracted condition, and accordingly, appear as simple cuts, as shown by the single slit line 38 adjacent the rear of the upper. However, as a foot is inserted into the slipper, or as the material is spread during the course of connecting it to the sole portion, the material on the sides of each of the slits move away from each other causing the slits to open up and form a somewhat oval shape, as shown by the slit 40, near the toe portion.

Figure 4:
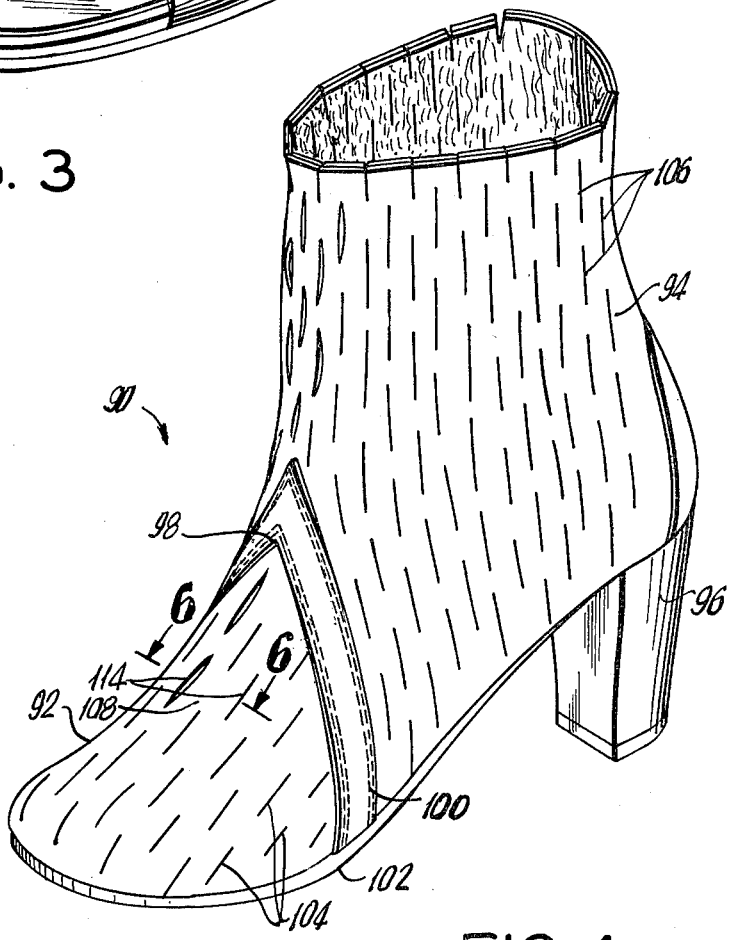
FIG. 4 is a perspective view of an embodiment of the present invention showing the article of footwear as a half boot.
Figure 7:
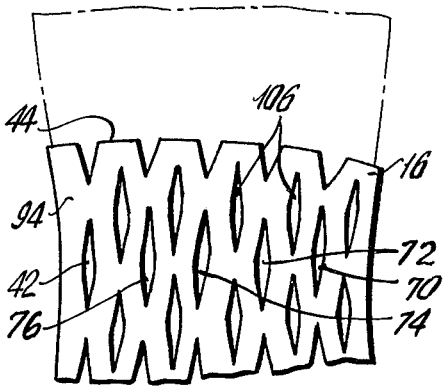
FIG. 7 is an enlarged elevational view of a portion of the upper of FIG. 4, showing the material in an expanded condition.

Referring to FIG. 7, a more detailed view is shown of the expanded upper of FIG. 4. It will be noted that the expanded slit 42 has opened up to form a somewhat oval shape with pointed opposing ends, forming an arrangement somewhat between an oval shape and a diamond shape. This arrangement is similar to that produced by a metal gate effect. The size of the opening formed at the slit portion will depend upon the amount of expansion caused by the foot. With a larger foot, the ovals will be wider and the material will expand more to accommodate the larger foot. With a smaller foot, the slits will only slightly expand.

It should again be appreciated with reference to FIG. 7, that the array of slits is such that the slits lie along the columns with slits in adjacent columns being staggered from each other. It should also be noted, with respect to FIG. 7, that the slits can actually continue all the way to the outer edge 44. This will permit the outer edge itself to expand thereby accommodating entry of the foot into the shoe.

It will also be appreciated that with the arrangement shown in FIG. 1, the upper can actually be stored in a complete flat condition lying adjacent to the sole portion. However, upon insertion of a foot into the slipper, the upper will expand to accommodate the foot. Furthermore, the size of the foot can vary wherein the upper will simply expand to accommodate such variation in size. It may be necessary to provide a series of such shoes, each accommodating a size range. For example, the slipper can be provided in small, medium and large sizes to thereby accommodate a great range of shoe sizes with only three basic slippers. However, it is not at all necessary to have a particular size for a particular corresponding foot size.

Additionally, it should be appreciated that during the course of daily routine, or with seasonal changes, as the foot size changes by swelling and contracting, the upper will simply expand to accommodate such changes without causing discomfort. Furthermore, it should be appreciated that even if the shape of the foot is abnormal, deformed, etc., the upper will accommodate such deformities by reshaping itself to conform to the actual shape of the foot.

Although the FIG. 1 embodiment is that of a slipper, it should be appreciated that the same concept of an expandable upper can be applied to other articles of footwear. For example, referring now to FIG. 2, there is shown an article of footwear 46 which is a shoe, such as a sandal, not only including a sole portion but also including a heel 48 beneath the sole 12. Furthermore, stitching 50 is provided to connect the insole and outsole together. In this embodiment, the upper 16 has an open toe portion. Furthermore, side air vents 52, 54 are provided adjacent the interconnection between the upper and the sole portion. Such vents permit the entry of air to flow into the shoe area providing more comfort, especially in summer use. It should be appreciated, however, that even in the absence of the air vents, the slits themselves provide airholes for more cooling and comfortable wearing of the shoe.

Figure 3:
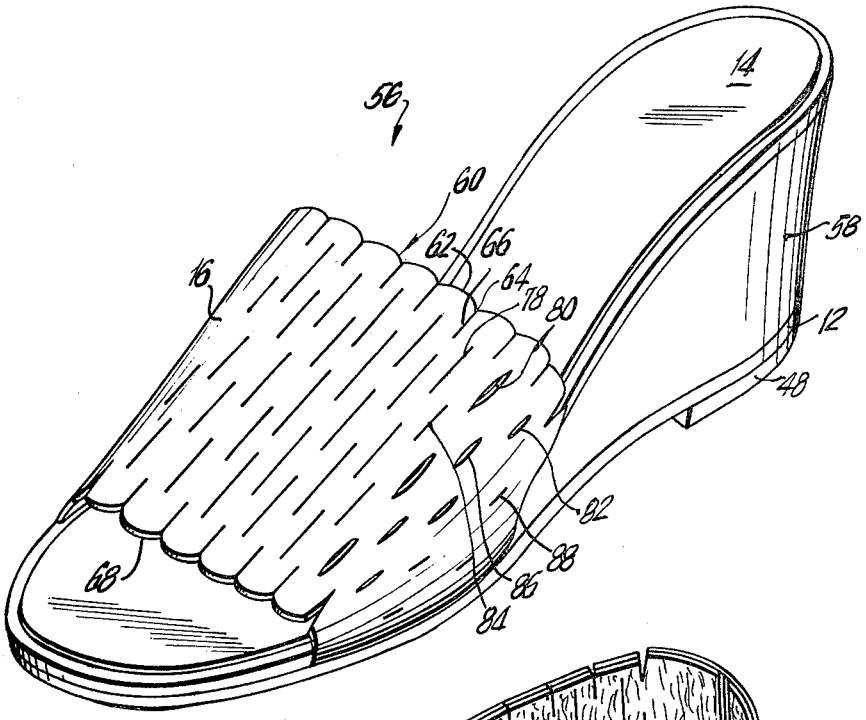
FIG. 3 is a perspective view of another embodiment of the present invention showing the article of footwear as a wedge type sandal with a scalloped edge.
Figure 5:
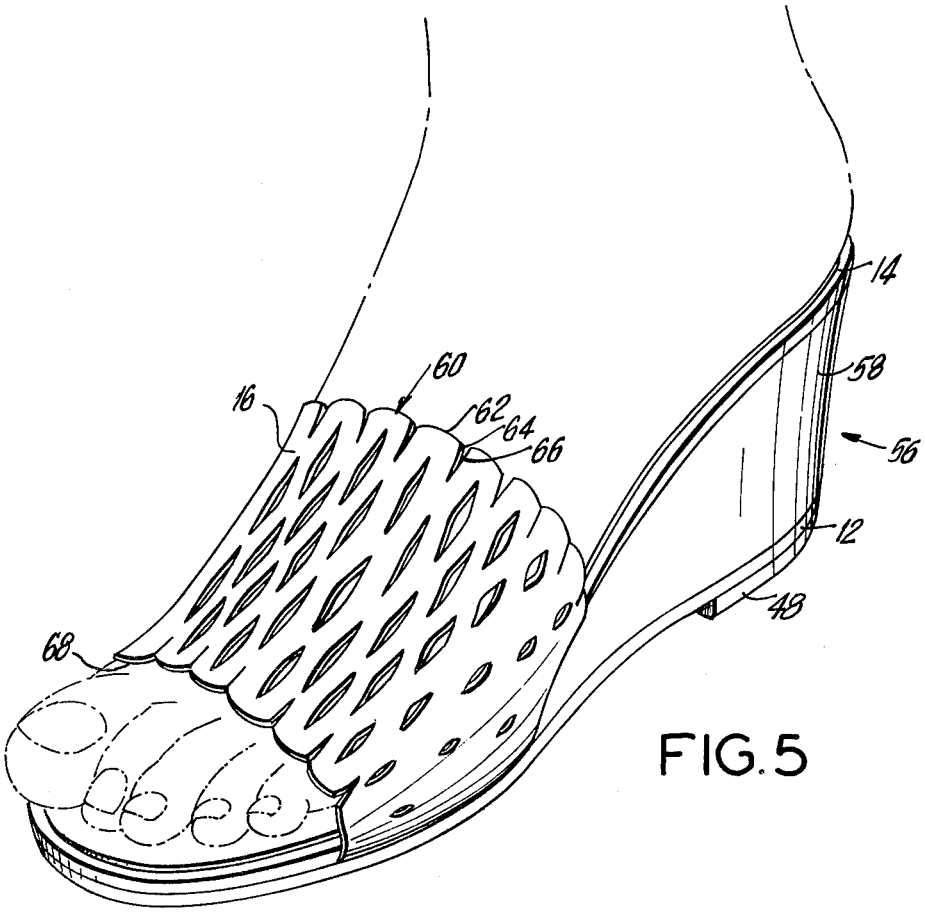
FIG. 5 is a perspective view similar to that shown in FIG. 3, showing the expansion of the footwear upon insertion of a foot.

A further embodiment of the footwear is shown in FIGS. 3 and 5, wherein the article of footwear 56 is shown as a wedge type shoe with the wedge portion 58 shown interspaced between the heel 48 and the insole 14. The wedge 58 can be of a sturdy material such as wood, leather, canvas, and the like, and can also include a decorative coating therearound. The upper 16 is shown formed with an open toe and is connected at the front portion to the outsole and along the arch to the portion beneath the insole and above the wedge.

The back edge of the upper is shown scalloped at 60. The scallops include arcs 62 which terminate at their lower edges 64 on slits 66. Accordingly, at the back edge, as the foot enters into the shoe, the edge itself will be able to expand to accommodate entry of the foot, as shown in FIG. 5. At the same time, because of the scalloped edge, a decorative style is achieved to avoid any marring of the beauty of the shoe as a result of the slits. A similar scalloped edge can be formed at the front edge 68 where the toes extend from the upper. This will also permit expansion at the edge while providing a decorative arrangement.

Figure 2:
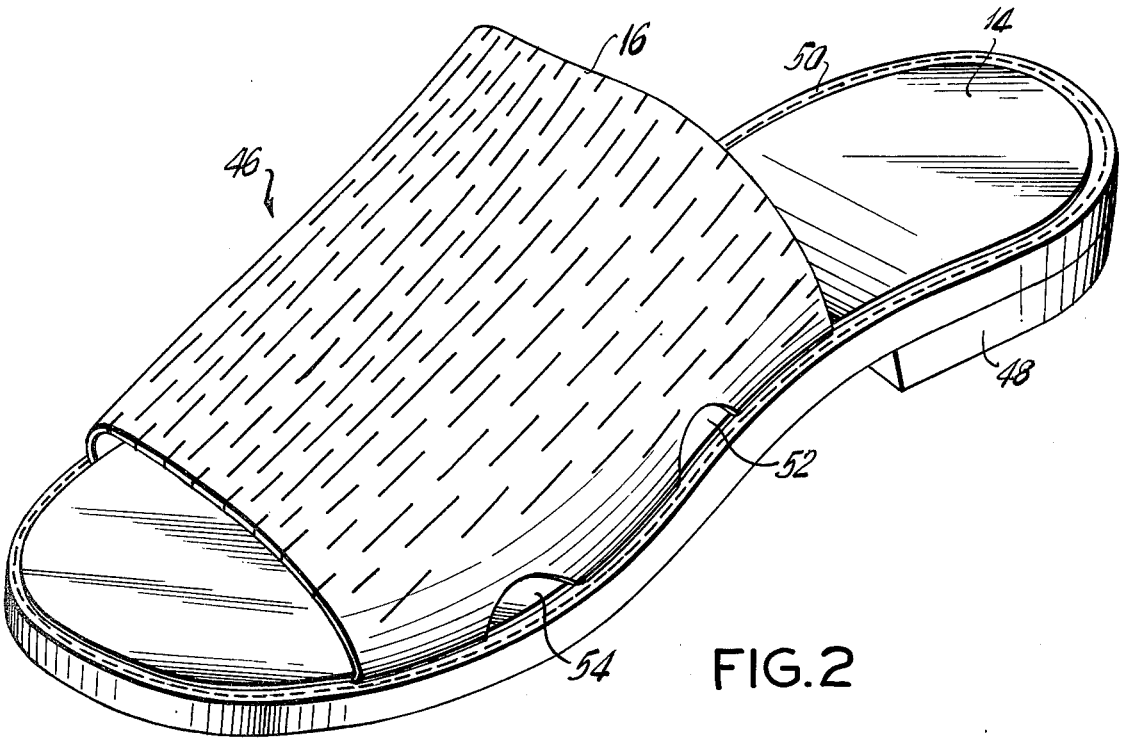
FIG. 2 is a perspective view of another embodiment of the present invention showing the article of footwear as a sandal with air vents.

In the embodiments of FIGS. 1, 2 and 7 thus far described, it will be noted that the various slits are all of uniform length and that the entire array is uniform. Accordingly, the slits lie in parallel transverse rows. More specifically, as will be seen for example in FIG. 7, the slits 70, 72, 74, 76, and 42, lying in a single transverse row, are all parallel to the slits in the next transverse row.

Referring again to FIGS. 3 and 5, it will be seen that such uniform length arrangement of the slits is not always required. FIG. 3 shows best that the transverse rows crossing the columns have a reduced slit length as they approach the sides of the upper. More specifically, while the slits in the center part of the upper are of uniform length, commencing with the column containing the slit 78, the transverse rows have reduced slit length. Thus, the slit 80 is of reduced length as compared to the slit 78 and similarly the slit 82 is of reduced length compared to the slit 80.

Similarly, in the next adjacent transverse row, the slit 84 is longer than the slit 86 which in turn is longer than the slit 88. It should be noted, however, that even in the embodiment shown in FIG. 3, the slits still lie in columns and are still spaced apart in the columnar direction. Also, the columns are still parallel to each other. However, since less stretching or expansion is required at the edges of the upper where they connect to the sole portion, the slits need not be of the same length. The greater expansion occurs near the center of the upper and accordingly these slits are bigger to accommodate such greater expansion needs.

Referring now to FIG. 4, there will be shown yet another embodiment of the present invention showing a half boot arrangement 90. In this arrangement, there is provided a section 92 of the upper covering the toe and vamp portions of the boot, and a further section 94 of the upper disposed on the heel 96 and the arch portion, the section 94 extending upwardly over the ankles to form the half boot style. A stiffening member 98 is interposed between these two sections 92, 94 of the upper which is stitched to each section by means of the stitching 100. The entire upper sits on the outsole 102.

In the section 92 of the upper, it will be noted that the elongated slits 104 lie in the longitudinal direction of the boot. On the other hand, in the section 94 of the upper, the slits 106 lie in a vertical direction, an enlarged portion of section 94 being shown in FIG. 7, as set forth above.

It should therefore be appreciated that the slits have their length dimension oriented in the direction of the foot form. Accordingly, in the toe and vamp portions of the shoe, where the foot shape is such as to lie longitudinally, colinearly with the axis of the shoe, the length dimension of the slits is oriented in the longitudinal or axial direction of the shoe. On the other hand, in the heel or ankle portion and portions thereabove, the foot extends in a vertical direction. Accordingly, the slits are such as to have their length dimension also oriented in the vertical direction.

It will thus be appreciated, that the slits are formed so as to accommodate the variations in size of the foot. For the ankle portion, the variations in size is in the circumference of the ankle portion and accordingly, the length direction of the slits are such as to permit the circumference of the boot or shoe to expand. On the other hand, around the toe portion, the variation in size is such so as to increase the circumference around the lower foot portion and accordingly, the length direction of the slits is to permit such circumferential expansion of the toe portion of the upper.

Figure 6:
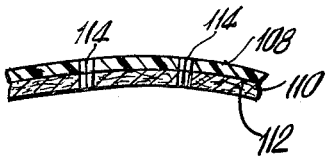
FIG. 6 is a cross-sectional view of the upper taken along line 6—6 of FIG. 4.

The material of the upper can be of any sturdy shoe material such as leather, plastic, or the like. In addition, there can be provided a lining on the underside of the upper. As can best be seen in FIG. 6, there is shown the upper 108 of the boot 90 shown in FIG. 4, the upper 108 being formed of plastic material and beneath it a lining 110 such as a felt, foam, or fabric lining which is adhered to the upper by means of an adhesive material 112. The slits 114 are formed through both the upper and the lining, in registration with each other. Thus, the expansion at the slits will cause expansion of both the upper and the lining thereunder.

The amount of expansion can be controlled by the spacing of the adjacent columns, the length of the slits, as well as the columnar distance between the slits. For example, by making the spacing between adjacent columns greater, there will be less expansion. Similarly, by making the distance between the slits of the same column greater, there will also be less expansion.

Numerous alterations of the structure herein disclosed will suggest themselves to those skilled in the art. However, it is to be understood that the present disclosure relates to a preferred embodiment of the invention which is for purposes of illustration only and is not to be construed as a limitation of the invention.

What is claimed is:

1. An expandable article of footwear comprising a sole with an upper disposed over at least a portion of said sole, a free edge of said upper providing an opening through which a foot enters into said article of footwear, said upper including means for permitting a major portion of said upper to expand, said means also permitting said free edge to expand to accommodate entry of the foot, said means including an array of elongated slits colinearly arranged into substantially parallel columns, said slits extending through said upper and being spaced apart in the columnar direction, said slits of adjacent columns being disposed in staggered relationship with each other, and said slits being substantially perpendicular to said free edge with a plurality of said slits extending through said free edge.

2. An expandable article of footwear as in claim 1, wherein a length dimension of each of said slits is oriented in a direction of the foot form.

3. An expandable article of footwear as in claim 1, wherein said upper includes a toe portion and a heel and ankle portion, said portions being interconnected by a stiffening seam member, said slits being in said heel and ankle portion, said slits being oriented in a substantially perpendicular direction of said sole.

4. An expandable article of footwear as in claim 3, wherein another array of elongated slits are provided in said toe portion with said toe portion slits being oriented along an elongated direction of said sole.

5. An expandable article of footwear as in claim 1, wherein the entire upper includes said array of elongated slits.

6. An expandable article of footwear as in claim 1, wherein said free edge of said upper is a scalloped edge defined by a plurality of arcs, ends of said scalloped edge arcs terminating in associated ones of said plurality of free edge slits.

7. An expandable article of footwear as in claim 6, wherein a toe portion of said upper is opened, said opened toe portion being defined by a scalloped edge having a plurality of arcs ending in associated ones of said slits which extend through said toe portion scalloped edge.

8. An expandable article of footwear as in claim 1, and further comprising a lining material adhered to an underside of said upper, and wherein said array of slits is provided in registration through both said upper and said lining material.

9. An expandable article of footwear as in claim 1, and further comprising vent holes positioned in said upper proximate its interconnection to said sole, each vent hole being larger than each slit.

10. An expandable article of footwear as in claim 1, wherein said slits are of uniform length.

11. An expandable article of footwear as in claim 1, wherein said slits in any given transverse row crossing said columns have a reduced slit length as they approach side ends of said upper adjacent to said sole.

12. An expandable article of footwear as in claim 1, wherein said slits are uniformly positioned such that they lie in parallel transverse rows crossing said columns.

13. An expandable article of footwear as in claim 1, wherein a toe portion of said upper is opened, said opened toe portion being defined by an opposite edge of said upper having a second plurality of slits extending therethrough.

* * * * *